US010249242B2

(12) United States Patent
Wu et al.

(10) Patent No.: US 10,249,242 B2
(45) Date of Patent: Apr. 2, 2019

(54) ORGANIC LIGHT EMITTING PIXEL DRIVING CIRCUIT, DRIVING METHOD AND ORGANIC LIGHT EMITTING DISPLAY PANEL

(71) Applicants: Shanghai Tianma AM-OLED Co., Ltd., Shanghai (CN); Tianma Micro-Electronics Co., Ltd., Shenzhen (CN)

(72) Inventors: Tong Wu, Shanghai (CN); Yue Li, Shanghai (CN); Renyuan Zhu, Shanghai (CN); Gang Liu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 11 days.

(21) Appl. No.: 15/469,947

(22) Filed: Mar. 27, 2017

(65) Prior Publication Data

US 2017/0200417 A1 Jul. 13, 2017

(30) Foreign Application Priority Data

Dec. 15, 2016 (CN) ..... 2016 1 1160758

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); (Continued)

(58) Field of Classification Search
CPC ..... G09G 3/3258
(Continued)

(56) References Cited

U.S. PATENT DOCUMENTS

2012/0038605 A1* 2/2012 Han ..... H05B 33/0896 345/211
2013/0088417 A1 4/2013 Kim et al.
(Continued)

FOREIGN PATENT DOCUMENTS

CN 104409042 A 3/2015

OTHER PUBLICATIONS

Chinese, 1st Office Action dated Jul. 5, 2018.

*Primary Examiner* — Long D Pham
(74) *Attorney, Agent, or Firm* — Alston & Bird LLP

(57) ABSTRACT

The present application discloses an organic light emitting pixel driving circuit, an organic light emitting display panel and a driving method thereof. One embodiment of the organic light emitting pixel driving circuit comprises: a storage unit, a coupling unit, a data writing unit, a light emitting control unit, a reset unit, a data line, a first scanning line, a second scanning line, a light emitting control line, a reference voltage line, an initialization voltage line, a light emitting element and a driving transistor. By writing a compensation voltage to a second electrode of the driving transistor and then to a gate of the driving transistor through the coupling unit, the embodiment avoids a noise from a parasitic capacitance generated by a signal change on the data line to the gate of the driving transistor, therefore a stable display is achieves.

14 Claims, 10 Drawing Sheets

(52) U.S. Cl.
CPC ..... *G09G 2300/043* (2013.01); *G09G 2300/0809* (2013.01)

(58) Field of Classification Search
USPC ..... 345/82
See application file for complete search history.

(56) References Cited

U.S. PATENT DOCUMENTS

| | | | | |
|---|---|---|---|---|
| 2014/0333513 | A1* | 11/2014 | Park | G09G 3/3266 345/76 |
| 2016/0155379 | A1* | 6/2016 | Na | G09G 3/3233 345/215 |
| 2016/0189635 | A1* | 6/2016 | Lee | G09G 3/3233 345/690 |

* cited by examiner

ORGANIC LIGHT EMITTING PIXEL DRIVING CIRCUIT, DRIVING METHOD AND ORGANIC LIGHT EMITTING DISPLAY PANEL

CROSS-REFERENCE TO RELATED APPLICATION

This application is related to and claims priority from Chinese Patent Application No. 201611160758.7, filed on Dec. 15, 2016, entitled "Organic Light Emitting Pixel Driving Circuit, Driving Method and Organic Light Emitting Display Panel," the entire disclosure of which is hereby incorporated by reference for all purposes.

TECHNICAL FIELD

The present application relates to the field of display technology, and specifically relates to an organic light emitting pixel driving circuit, a driving method and an organic light emitting display panel.

BACKGROUND

With the development of the display technology, liquid crystal display (LCD) and organic light emitting Diode (OLED) display have been widely used in various portable electronic devices as two mainstream display devices.

An OLED display comprises an organic light emitting diode pixel array and an organic light emitting pixel driving circuit driving each pixel. FIG. 1 shows a schematic diagram of an organic light emitting pixel driving circuit of existing technology.

As shown in FIG. 1, an organic light emitting pixel driving circuit includes an organic light emitting diode D1, a driving transistor DT, a storage capacitor C1, a first switching transistor T1, a second switching transistor T2, a data line Data, a scanning line S1, a light emitting control line EMIT, a first power source voltage terminal VDD and a second power source voltage terminal VEE.

The scanning line S1 first provides a low level signal. The first switching transistor T1 is turned on. The data voltage signal on the data line Data is written to a node N1, and held constant in one frame period by the storage capacitor C1. The light emitting control line EMIT then provides a low level signal. The second switching transistor T2 is turned on, and the organic light emitting diode D1 illuminates.

However, in the layout design of an OLED display panel using the existing technology, the metal layer in which the data line Data is located usually covers (or partially covers) the metal layer in which the gate of the driving transistor DT is located, and a row of pixels commonly share a single data line Data. The signal on the data line Data is constantly changing as the scanning line is switched (for example, from scanning the first line to scanning the second line), and a parasitic capacitance generated by a signal change on the data line Data acts on the gate of the driving transistor DT through an overlapping portion between two metal layers, which then affects the data voltage held by the storage capacitor C1, generating a crosstalk.

In view of the above defects and disadvantage in existing technology, it is desired to provide an organic light emitting pixel driving circuit, a driving method and an organic light emitting display panel to solve the technical problems in existing technology.

SUMMARY

According to one aspect of the present application, an organic light emitting pixel driving circuit is provided, comprising: a storage capacitor unit, a coupling unit, a data writing unit, a light emitting control unit, a reset unit, a data line, a first scanning line, a second scanning line, a light emitting control line, a reference voltage line, an initialization voltage line, a light emitting element and a driving transistor. The storage capacitor unit is connected to a gate of the driving transistor for maintaining a voltage transferred to the gate of the driving transistor. The coupling unit is connected to a second electrode of the driving transistor, the reset unit and the data writing unit. The data writing unit is connected to the reference voltage line for transmitting a signal on the reference voltage line to the coupling unit based on a signal of the second scanning line. The light emitting control unit is connected to the second electrode of the driving transistor and an anode of the light emitting element for controlling the light emitting element to emit light based on a signal of the light emitting control line. The reset unit is connected to the initialization voltage line, the data line, the anode of the light emitting element, the coupling unit, the gate of the driving transistor and the second electrode of the driving transistor for resetting a potential of the anode of the light emitting element, a potential of the gate of the driving transistor and a potential of the second electrode of the driving transistor based on a signal of the first scanning line, and transmitting a signal on the data line to the coupling unit. A cathode of the light emitting element is connected to a first power source voltage line. A first electrode of the driving transistor is connected to the second power source voltage line.

According to another aspect of the present application, a driving method for driving an organic light emitting pixel driving circuit is further provided, comprising: in an initialization period, the initialization voltage line providing an initialization voltage signal, the data line providing a data voltage signal, the light emitting control unit being turned on based on a signal of the light emitting control line, the reset unit transmitting the initialization voltage signal to an anode of the light emitting element, a second electrode of the driving transistor and a gate of the driving transistor based on a signal of the first scanning line, and transmitting the data voltage signal to the coupling unit; in a threshold voltage detection period, the second power source voltage line providing a second voltage signal, the light emitting control unit being turned off based on the signal of the light emitting control line, a voltage signal on the gate and the second electrode of the driving transistor rising from the initialization voltage signal to a value below the second voltage signal, and completing a threshold detection to the driving transistor; in a data wiring period, the data line providing a high resistance signal, the reference voltage line providing a reference voltage signal, the data writing unit transmitting the reference voltage signal to the coupling unit based on a signal of the second scanning line, and first transmitting a voltage signal change on the coupling unit to the second electrode of the driving transistor through a coupling action of the coupling unit and then to the gate of the driving transistor, and completing the writing of the data; in a light emitting period, the reset unit being turned off based on the signal of the first scanning line, the light emitting control unit being turned on based on the signal of the light emitting control line, and the light emitting element emitting light.

According to another aspect of the present application, an organic light emitting display panel is provided, comprising: a plurality of rows of pixel units and a plurality of columns of pixel units, each row of the pixel units including a plurality of the organic light emitting pixel driving circuits.

By writing a compensation voltage to the second electrode of the driving transistor and then to the gate of the driving transistor through the coupling unit, the solution provided by the present application avoids an influence of a parasitic capacitance generated by a signal change on the data line to the gate of the driving transistor and achieves a stable display.

BRIEF DESCRIPTION OF THE DRAWINGS

Other features, objectives and advantages of the present application will become more apparent upon reading the detailed description to non-limiting embodiments with reference to the accompanying drawings, including.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1:
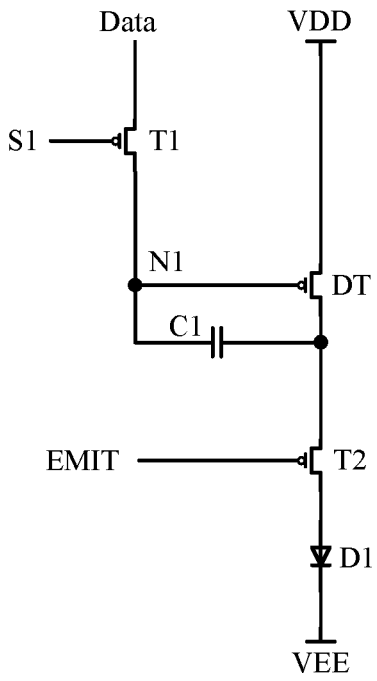
FIG. 1 shows a schematic diagram of an organic light emitting driving circuit of existing technology.
Figure 2:
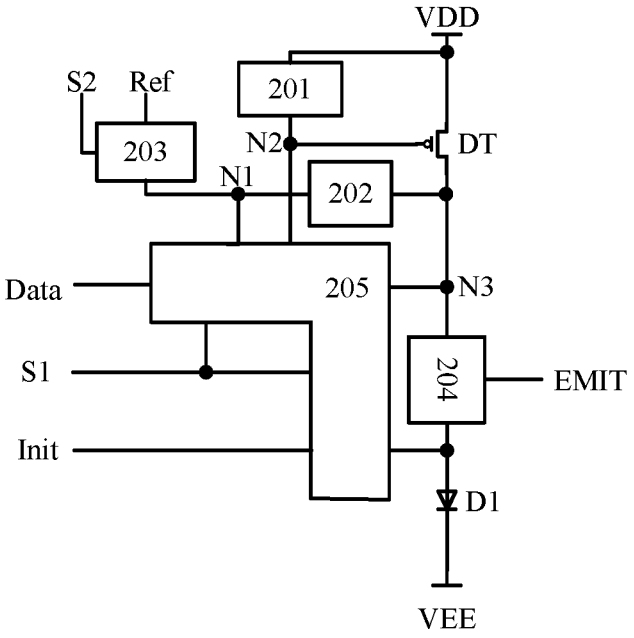
FIG. 2 shows a schematic diagram of an embodiment of an organic light emitting pixel driving circuit of the present application.

FIG. 2 shows a schematic diagram of an embodiment of an organic light emitting pixel driving circuit of the present application.

As shown in FIG. 2, the organic light emitting pixel driving circuit may include a storage unit 201, a coupling unit 202, a data writing unit 203, a light emitting control unit 204, a reset unit 205, a data line Data, a first scanning line S1, a second scanning line S2, a light emitting control line EMIT, a reference voltage line Ref, an initialization voltage line Init, a light emitting element D1 and a driving transistor DT.

When the storage unit 201 is connected to the gate of the driving transistor DT to pass a voltage transferred to the gate of the driving transistor DT. The coupling unit 202 is connected to a second electrode of the driving transistor DT, the reset unit 205 and the data writing unit 203. The data writing unit 203 is connected to the reference voltage line Ref to transmit the signal on the reference voltage line Ref to the coupling unit 202 based on the signal of the second scanning line S2. The light emitting control unit 204 is connected to the second electrode of the driving transistor DT at one terminal and the anode of the light emitting element D1 at the other terminal, to control the light emitting element D1 to emit light based on signals from the light emitting control line EMIT. The reset unit 205 is connected to the initialization voltage line Init, the data line Data, the anode of the light emitting element D1, the coupling unit 202, the gate of the driving transistor DT and the second electrode of the driving transistor DT to reset the potential of the anode of the light emitting element D1, the potential of the gate of the driving transistor DT, and the potential of the second electrode of the driving transistor DT based on a signal from the first scanning line S1. In addition, the reset unit 205 transmits the signal on the data line Data to the coupling unit 202. The cathode of the light emitting element D1 is connected to a first power source voltage line VEE. The first electrode of the driving transistor DT is connected to a second power source voltage line VDD.

Figure 3A:
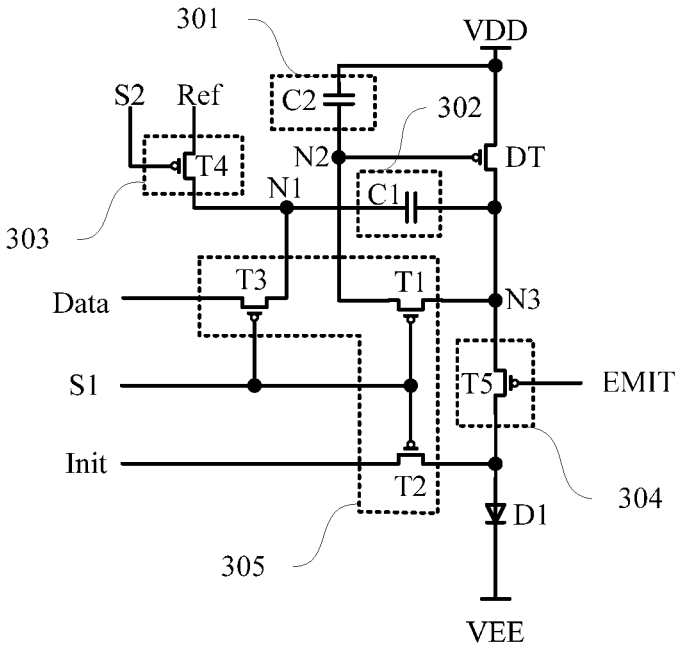
FIG. 3A shows a schematic diagram of an implementation of the organic light emitting pixel driving circuit shown in FIG. 2.

With further reference to FIG. 3A, a schematic diagram of an implementation of the organic light emitting pixel driving circuit shown in FIG. 2 is shown.

The organic light emitting driving circuit shown in FIG. 3A is an implementation of the organic light emitting pixel driving circuit shown in FIG. 2. Therefore, the organic light emitting driving circuit also includes a storage unit 301, a coupling unit 302, a data writing unit 303, a light emitting control unit 304, a reset unit 305, a data line Data, a first scanning line S1, a second scanning line S2, a light emitting control line EMIT, a reference voltage line Ref, an initialization voltage line Init, a light emitting element D1 and a driving transistor DT.

The coupling unit 302 may include a first capacitor C1. A second terminal of the first capacitor C1 is connected to the second electrode of the driving transistor DT, and a first terminal of the first capacitor C1 receives a signal provided by the reset unit 305 or the data writing unit 303.

The reset unit 305 may include a first switching transistor T1, a second switching transistor T2 and a third switching transistor T3. Gates of the first switching transistor T1, the second switching transistor T2 and the third switching transistor T3 are connected to the first scanning line S1. A first electrode of the first switching transistor T1 is connected to the gate of the driving transistor DT. A second electrode of the first switching transistor T1 is connected to the second electrode of the driving transistor DT. A first electrode of the second switching transistor T2 is connected to the initialization voltage line Init. A second electrode of the second switching transistor T2 is connected to the anode of the light emitting element D1. A first electrode of the third switching transistor T3 is connected to the data line Data. A second electrode of the third switching transistor T3 is connected to the coupling unit 302.

The data writing unit 303 may include a fourth switching transistor T4. A gate of the fourth switching transistor T4 is connected to the second scanning line S2, a second electrode of the fourth switching transistor T4 is connected to the coupling unit 302, and a first electrode of the fourth switching transistor T4 is connected to the reference voltage line Ref.

The storage unit 301 may include a second capacitor C2. Wherein a second terminal of the second capacitor C2 is connected to the gate of the driving transistor DT, and a first terminal of the second capacitor C2 is connected to the second power source voltage line VDD.

The light emitting control unit 304 may include a fifth switching transistor T5. A gate of the fifth switching transistor T5 is connected to the light emitting control line EMIT, a first electrode of the fifth switching transistor T5 is connected to the second electrode of the driving transistor DT, and a second electrode of the fifth switching transistor T5 is connected to the anode of the light emitting element D1.

Although FIG. 3A shows that the first switching transistor T1, the second switching transistor T2, the third switching transistor T3, the fourth switching transistor T4, the fifth switching transistor T5, and the driving transistor DT are PMOS (Positive Channel Metal Oxide Semiconductor, P channel metal oxide semiconductor) transistors, this is merely illustrative. It may be understood that the first switching transistor T1, the second switching transistor T2, the third switching transistor T3, the fourth switching transistor T4, the fifth switching transistor T5 and the driving transistor DT may also be NMOS (Negative channel Metal Oxide Semiconductor, N channel metal oxide semiconductor) transistors, or several of them may be NMOS transistors. Those skilled in the art may set this up according to the needs of the actual application scenario.

In the following description, PMOS transistors are taken as examples, the first switching transistor T1, the second switching transistor T2, the third switching transistor T3, the fourth switching transistor T4, the fifth switching transistor T5, and the driving transistor DT, combined with the timing sequence diagram shown in FIG. 4 and the equivalent circuit diagram shown in FIG. 5A to 5D, describe the operation principle of the organic light emitting pixel driving circuit shown in FIG. 3A.

Figure 5A:
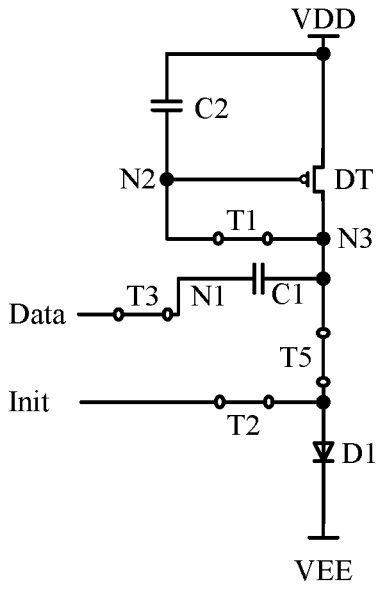
FIG. 5A to 5D show an equivalent schematic diagram of the organic light emitting pixel driving circuit shown in FIG. 3A at each temporal stage in FIG. 4.

Stage P1: The data line Data provides a data voltage signal $V_{data}$. The initialization voltage line Init provides a reference voltage signal $V_{init}$. The first power source voltage terminal VEE provides a first voltage signal Vee. The second power source voltage terminal VDD provides a second voltage signal Vdd. The first scanning line S1 and the light emitting control line EMIT provide low level signals respectively. The second scanning line S2 provides a high level signal. The first switching transistor T1, the second switching transistor T2, the third switching transistor T3, the fifth switching transistor T5, and the driving transistor DT are turned on. The fourth switching transistor T4 is turned off. The equivalent circuit of the organic light emitting pixel driving circuit is as shown in FIG. 5A.

At this stage, since the potential difference between the first voltage signal Vee and the second voltage signal Vdd is large (usually larger than 10 v), the driving transistor DT operates in a saturated state. A gate (i.e., the second node N2) potential $V_g$ of the driving transistor DT and a second electrode (i.e., the third node N3) potential Vd of the driving transistor DT are both $V_{init}$. A first terminal (i.e., the first node N1) potential V1 of the first capacitor C1 is $V_{data}$.

Figure 5B:
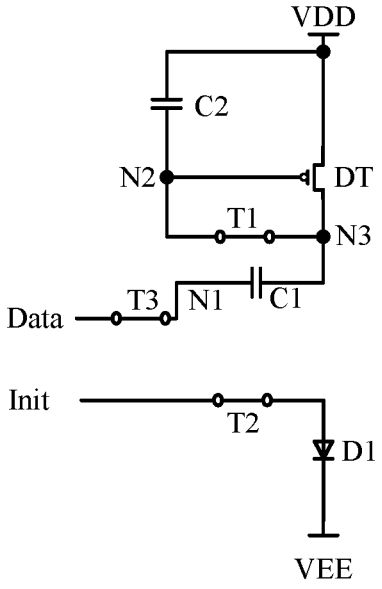

Stage P2: The first scanning line S1 provides a low level signal. The second scanning line S2 and the light emitting control line EMIT provide a high level signal. The first switching transistor T1, the second switching transistor T2, the third switching transistor T3 and the driving transistor DT are turned on. The fourth switching transistor T4 and the fifth switching transistor T5 are turned off. The equivalent circuit of the organic light emitting pixel driving circuit is as shown in FIG. 5B.

At this stage, the second voltage signal Vdd charges the first capacitor C1 and the second capacitor C2 to gradually raise the potential Vg of the second node N2 and the potential Vd of the third node N3 from $V_{init}$ to $Vdd-|V_{th}|$ and then stops charging. The potential Vg of the second node N2 and the potential Vd of the third node N3 are held by the second capacitor C2, and the potential V1 of the first node N1 is $V_{data}$. Here, $V_{th}$ is a threshold voltage of the driving transistor DT.

Figure 5C:
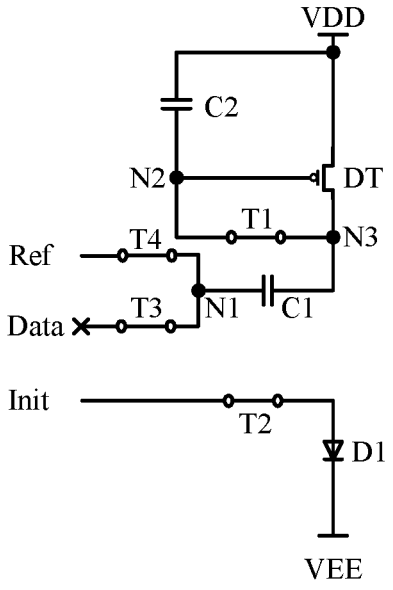

Stage P3: The data line Data is in a high impedance state. The reference voltage line Ref provides a reference voltage signal $V_{ref}$. The first scanning line S1 and the second scanning line S2 provide low level signals. The light emitting control line EMIT continues to provide a high-level signal. The first switching transistor T1, the second switching transistor T2, the third switching transistor T3, and the fourth switching transistor T4 are turned on. The fifth switching transistor T5 is turned off. The equivalent circuit of the organic light emitting pixel driving circuit is as shown in FIG. 5C.

At this stage, the potential V1 of the first node N1 changes from $V_{data}$ to $V_{ref}$, and due to the coupling action of the first capacitor C1, the potential change ΔV of the third node N3 is:

$$\Delta V = \frac{c_1(V_{ref} - V_{data})}{c_1 + c_2} \tag{1}$$

Wherein, c1 is the capacitance value of the first capacitor C1, and c2 is the capacitance value of the second capacitor C2;

In this way, the potential Vg of the second node N2 and the potential Vd of the third node N3 are changed to:

$$V_g = V_d = Vdd - |V_{th}| - \frac{c_1(V_{ref} - V_{data})}{c_1 + c_2} \tag{2}$$

Then, the signal provided by the first scanning line S1 may be changed from a low level signal to a high level signal. The first switching transistor T1, the second switching transistor T2, and the third switching transistor T3 are all turned off. The potential Vg of the second node N2 is held by the second capacitor C2.

Figure 5D:
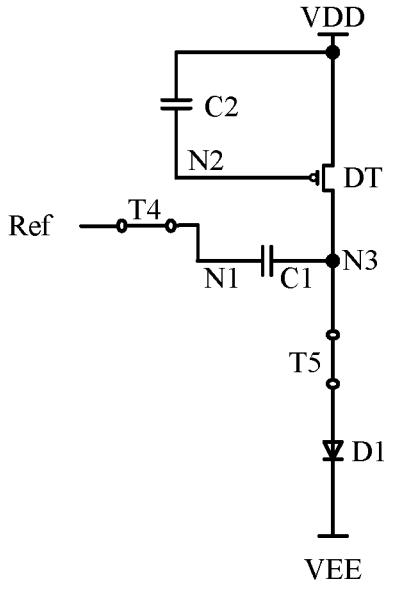

Stage P4: The first scanning line S1 provides a high level signal. The second scanning line S2 and the light emitting control line EMIT provide low level signals. The fourth switching transistor T4, the fifth switching transistor T5, and the driving transistor DT are turned on. The first switching transistor T1, the second switching transistor T2, and the third switching transistor T3 are turned off. The light emitting element D1 emits light. The equivalent circuit of the organic light emitting pixel driving circuit is as shown in FIG. 5D.

At this stage, the potential Vg of the second node N2 is $$Vdd - |V_{th}| - \frac{c_1(V_{ref} - V_{data})}{c_1 + c_2}.$$

The potential Vd of the third node N3 is $V_{oled}$ (here, $V_{oled}$ is the potential of the anode of the light emitting element D1). The potential V1 of the first node N1 is $V_{ref}$. The source electrode (or the first electrode) potential Vs of the driving transistor DT is Vdd.

By the current formula of a transistor in the saturation region:

$$I=k(|V_{gs}|-|V_{th}|)^2 \quad (3)$$

Where, $V_{gs}$ is the potential difference between the gate and the source electrode of the driving transistor DT;

$$k = \frac{1}{2}\mu c_{ox}\frac{w}{l};$$

μ is the mobility rate of the driving transistor DT. $c_{ox}$ is the capacitance value of the gate oxide layer per unit area of the driving transistor DT.

$$\frac{w}{l}$$

is the channel width ratio of the driving transistor DT.

It can be calculated that in the P4 stage, the light emitting current flowing through the light emitting element D1 is:

$$I_{oled} = k\left(Vdd - \left(Vdd - |V_{th}| - \frac{c_1(V_{ref} - V_{data})}{c_1 + c_2}\right) - |V_{th}|\right)^2 \quad (4)$$

By simplifying the formula (4), the light emitting current flowing through the light emitting element D1 in the 4 stage is:

$$I_{oled} = k\left(\frac{c_1(V_{ref} - V_{data})}{c_1 + c_2}\right)^2 \quad (5)$$

As can be seen from the formula (5), the light emitting current $I_{oled}$ is independent of the threshold voltage $V_{th}$ of the driving transistor DT. Therefore, when the capacitance value c1 of the first capacitor C1 and the capacitance value c2 of the second capacitor C2 do not change, and the same reference voltage signal $V_{ref}$ and the data voltage signal $V_{data}$ are applied to the organic light emitting pixel driving circuit of the present embodiment, the same light emitting current $I_{oled}$ can be obtained, thereby avoiding an influence of the threshold voltage $V_{th}$ of the driving transistor DT to the light emitting current $I_{oled}$.

In addition, after the organic light emitting pixel driving circuit of the existing technology performs a threshold voltage compensation, the light emitting current usually depends only on one variable—the data voltage signal (for example, $I_{oled}=k(V_{data}-V_{ref})^2$). In the case where the light emitting current is determined, the dynamic range of the data signal is quite limited, which is disadvantageous for achieving a better display quality (for example, richer color display, more gray scale levels, etc.). However, in the present embodiment, it can be seen from formula (5) that the light emitting current is related not only to the data voltage signal but also to the first capacitor C1 and the second capacitor C2. Therefore, the data voltage signal $V_{data}$ applied to the organic light emitting pixel driving circuit may have a wider value range by adjusting the capacitance value of the first capacitor C1 and the capacitance value of the second capacitor C2, so that a better display quality can be achieved.

In addition, in the present embodiment, the coupling unit 302 (e.g., the first capacitor C1) and the third node N3 are added to the organic light emitting pixel driving circuit. On the one hand, by adjusting the coupling unit 302 and the storage unit 301, the data voltage signal $V_{data}$ may have a wider value range. On the other hand, the data voltage signal after compensation is first written to the third node N3 (i.e., the second electrode of the driving transistor DT), and then to the second node N2 (i.e., the gate of the driving transistor DT) to avoid the impact passed by the capacitor generated by a sudden signal change on the data line Data, which will be described below with reference to FIG. 3B.

Figure 3B:
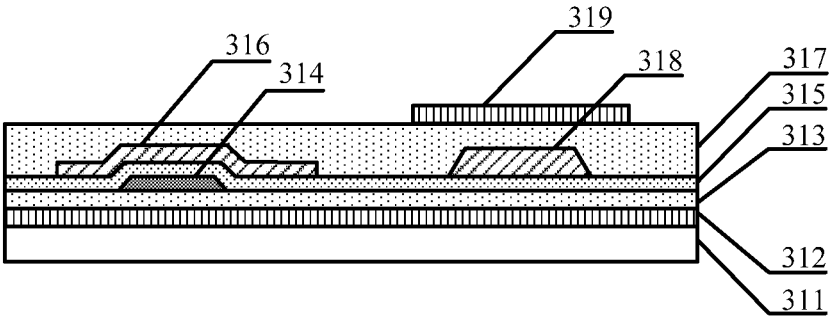
FIG. 3B shows a cross sectional view of the drive transistor, data line, capacitors, and nodes in the organic light emitting pixel in FIG. 3A.

As shown in FIG. 3B, the organic light emitting pixel possessing the above organic light emitting pixel driving circuit may include a glass substrate 311, and a polysilicon layer 312, a gate insulating layer 313, a gate 314, an interlayer insulating layer 315, a first metal electrode 316, a second metal electrode 318, a passivation layer 317, and a third metal electrode 319, sequentially fabricated on the glass substrate 311. The first metal electrode 316 and the second metal electrode 318 are made in the same metal layer and insulated from each other, and the third metal electrode 319 is provided on a different metal layer from the first metal electrode 316 and the second metal electrode 318. The first metal electrode 316 covers the gate 314. The third metal electrode 319 sits over the second metal electrode 318. The first metal electrode 316 and the third metal electrode 319 do not overlap each other (i.e., no overlapping region).

The first metal electrode 316 is connected to the second power source voltage line VDD, and the second capacitor C2 is formed between the first metal electrode 316 (connecting to the second power source voltage line VDD) and the gate 314 (connecting to the second node N2). The third metal electrode 319 is connected to the data line Data. The second metal electrode 318 is connected to the second electrode of the driving transistor DT through a contact hole (not shown in FIG. 3B). The first capacitor C1 is formed between the third metal electrode 319 (connecting to the data line Data) and the second metal electrode 318 (connecting to the second electrode of the driving transistor DT, i.e., the third node N3). Thus, the third metal electrode 319 and the first metal electrode 316 or gate 314 are separated from each other, and the signal change on the data line Data does not generate a noise or crosstalk from any capacitance coupling between the third metal electrode 319 and the first metal electrode 316 or gate 314, thus does not impact the data voltage held by the second capacitor C2, avoiding (or greatly weakened) the crosstalk due to the signal change and achieving a stable display.

Figure 6:
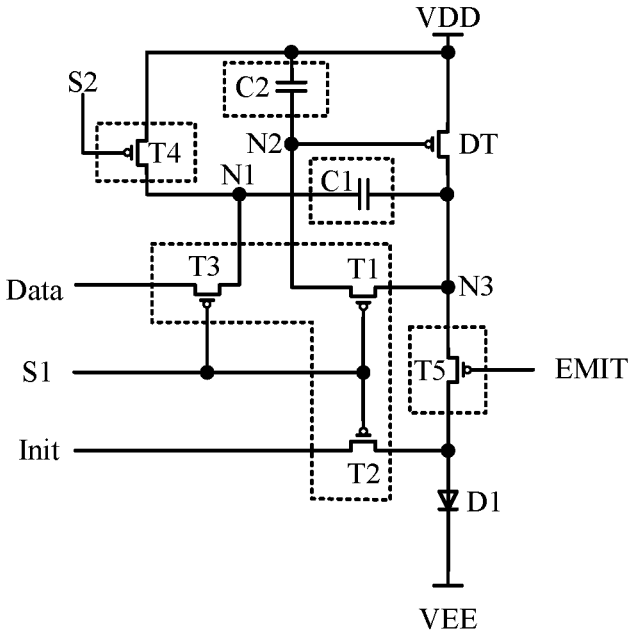
FIG. 6 shows a schematic diagram of another embodiment of the organic light emitting pixel driving circuit of the present application.

With further reference to FIG. 6, a schematic diagram of another embodiment of the organic light emitting pixel driving circuit of the present application is shown.

Most units in the configuration of the embodiment shown in FIG. 6 are the same as those of the embodiment shown in FIG. 3A. In the following description, parts that are the same as those of the embodiment shown in FIG. 3A will not be described again and the differences will be specifically pointed out.

As shown in FIG. 6, which is different from the embodiment shown in FIG. 3A, in the organic light emitting pixel driving circuit, a first electrode (can be its source or drain) of the fourth switching transistor T4 is connected to the second power source voltage line VDD. Thus, the organic light emitting pixel driving circuit of the present embodiment does not require the reference voltage line, which reduces the use of the signal line and saves the layout area occupied by the organic light emitting pixel driving circuit.

The operation principle of the organic light emitting pixel driving circuit of this embodiment is basically the same as that of the organic light emitting pixel driving circuit shown in FIG. 3A, the differences are:

In the P3 stage, the potential change ΔV of the third node N3 is $$\frac{c_1(Vdd - V_{data})}{c_1 + c_2},$$

the potential Vg of the second node N2 is $$Vdd - |V_{th}| - \frac{c_1(Vdd - V_{data})}{c_1 + c_2}.$$

Thus, the light emitting current flowing through the light emitting element D1 in the P4 stage can be calculated:

$$I_{oled} = k\left(\frac{c_1(Vdd - V_{data})}{c_1 + c_2}\right)^2 \quad (6)$$

It can be seen from the formula (6) that the light emitting current $I_{oled}$ is independent of the reference voltage signal, thus eliminating an influence of the reference voltage signal to the organic light emitting pixel driving circuit, as well as reducing an interference between signal lines, therefore a stable light emitting of the organic light emitting pixel driving circuit is maintained.

Figure 7:
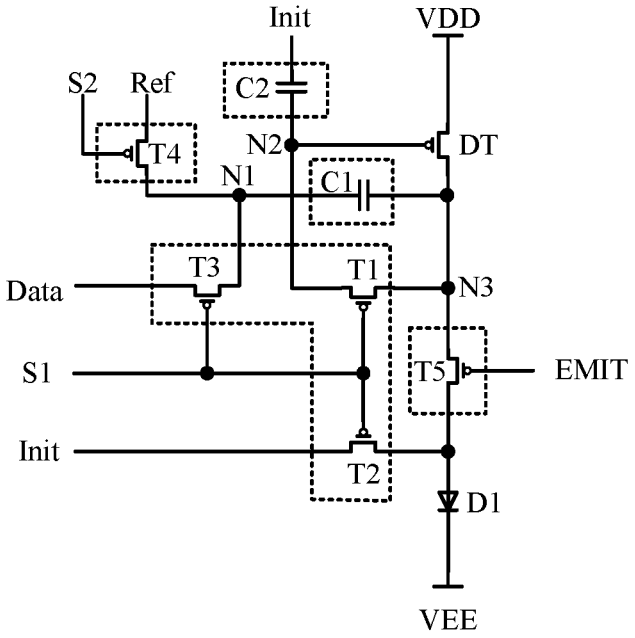
FIG. 7 shows a schematic diagram of another embodiment of the organic light emitting pixel driving circuit of the present application.

With further reference to FIG. 7, a schematic diagram of another embodiment of the organic light emitting pixel driving circuit of the present application is shown.

Most units of the configuration of the embodiment shown in FIG. 7 are the same as those of the embodiment shown in FIG. 3A. In the following description, parts that are the same as those of the embodiment shown in FIG. 3A will not be described again and the differences will be specifically described.

As shown in FIG. 7, which is different from the embodiment shown in FIG. 3A, in the organic light emitting pixel driving circuit, the first terminal of the second capacitor C2 is connected to the initialization voltage line Init. Thus, the load on the second power source voltage line VDD is reduced, so that the second source signal Vdd is more stable, which enables a stable output from the light emitting of the organic light emitting pixel driving circuit.

In addition, the present application further discloses a driving method of the organic light emitting pixel driving circuit for driving the organic light emitting pixel driving circuit including the above embodiments.

Figure 8:
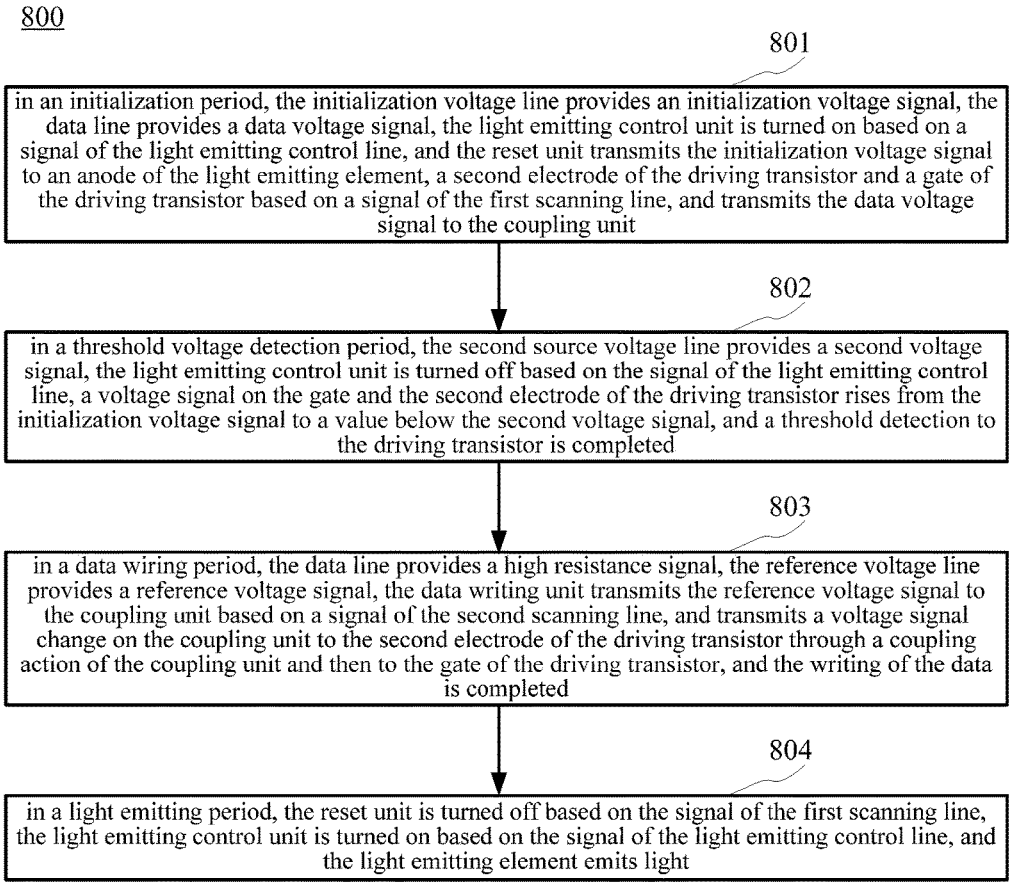
FIG. 8 shows a schematic flowchart of a driving method for driving the organic light emitting pixel driving circuit of the embodiments of the present application.

FIG. 8 shows an operation flowchart 800 of a driving method for driving the organic light emitting pixel driving circuit of the embodiments of the present application in one frame period.

Step 801: in an initialization period, the initialization voltage line provides an initialization voltage signal, the data line provides a data voltage signal, the light emitting control unit is turned on based on a signal of the light emitting control line, and the reset unit transmits the initialization voltage signal to an anode of the light emitting element, a second electrode of the driving transistor and a gate of the driving transistor based on a signal of the first scanning line, and transmits the data voltage signal to the coupling unit.

Step 802: in a threshold voltage detection period, the second power source voltage line provides a second voltage signal, the light emitting control unit is turned off based on the signal of the light emitting control line, a voltage signal on the gate and the second electrode of the driving transistor rises from the initialization voltage signal to a value below the second voltage signal, and a threshold detection to the driving transistor is completed.

Step 803: in a data wiring period, the data line provides a high resistance signal, the reference voltage line provides a reference voltage signal, the data writing unit transmits the reference voltage signal to the coupling unit based on a signal of the second scanning line, and transmits a voltage signal change on the coupling unit to the second electrode of the driving transistor through a coupling action of the coupling unit and then to the gate of the driving transistor, and the writing of the data is completed.

Step 804: in a light emitting period, the reset unit is turned off based on the signal of the first scanning line, the light emitting control unit is turned on based on the signal of the light emitting control line, and the light emitting element emits light.

Figure 4:
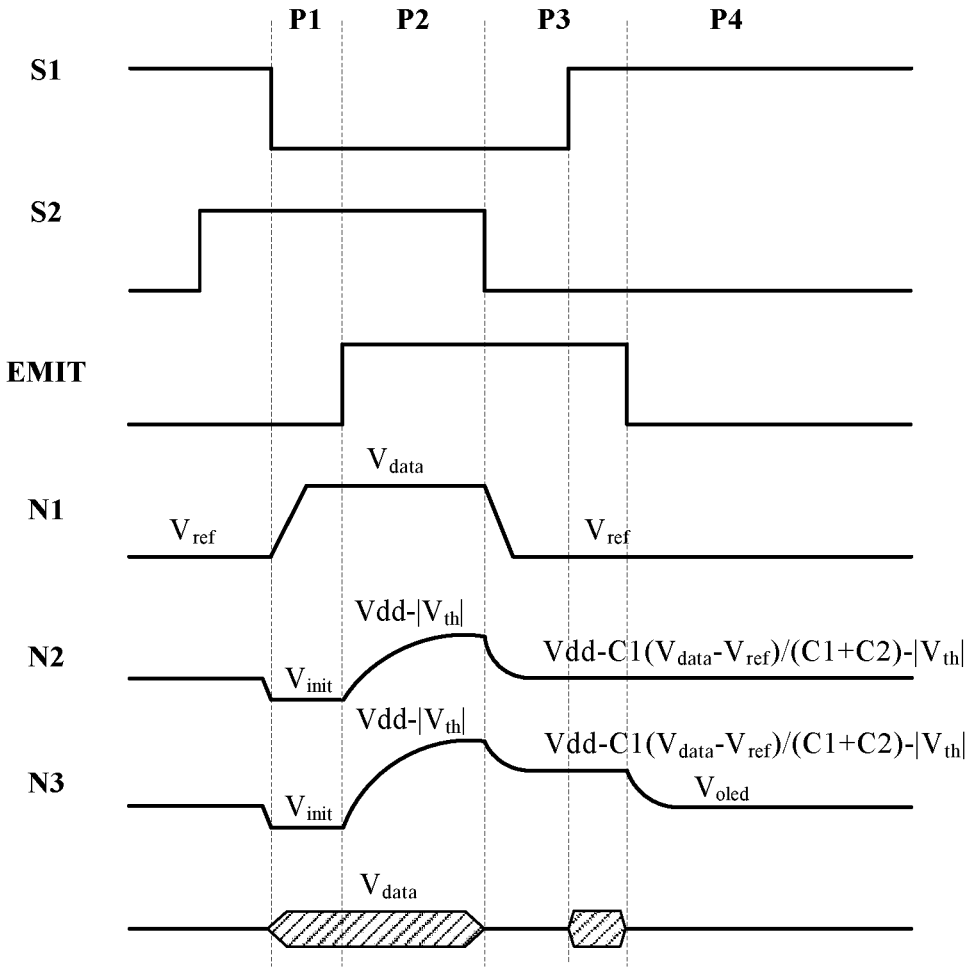
FIG. 4 shows a timing sequence diagram for driving the organic light emitting pixel driving circuit shown in FIG. 3A.

Here, when the driving method of the organic light emitting pixel driving circuit of the present embodiment is applied to the organic light emitting pixel driving circuit of the present application (for example, the organic light emitting pixel driving circuit shown in FIGS. 3A, 6 and 7), the timing sequence diagrams of the respective signals of the steps 801 to 804 are shown in FIG. 4.

Alternatively, in the driving method of the present embodiment, the reference voltage signal may not be larger than a first voltage signal provided by the first power source voltage line. In this case, it is possible to prevent the light emitting element from emitting light due to a leak current caused by a voltage signal applied to the anode of the light emitting element which is larger than a voltage signal applied to the cathode of the light emitting element in the initialization period (see P1 stage as shown in FIG. 4). Thus, the dark state display effect of the organic light emitting display panel using the driving method of the present embodiment can be improved.

Figure 9:
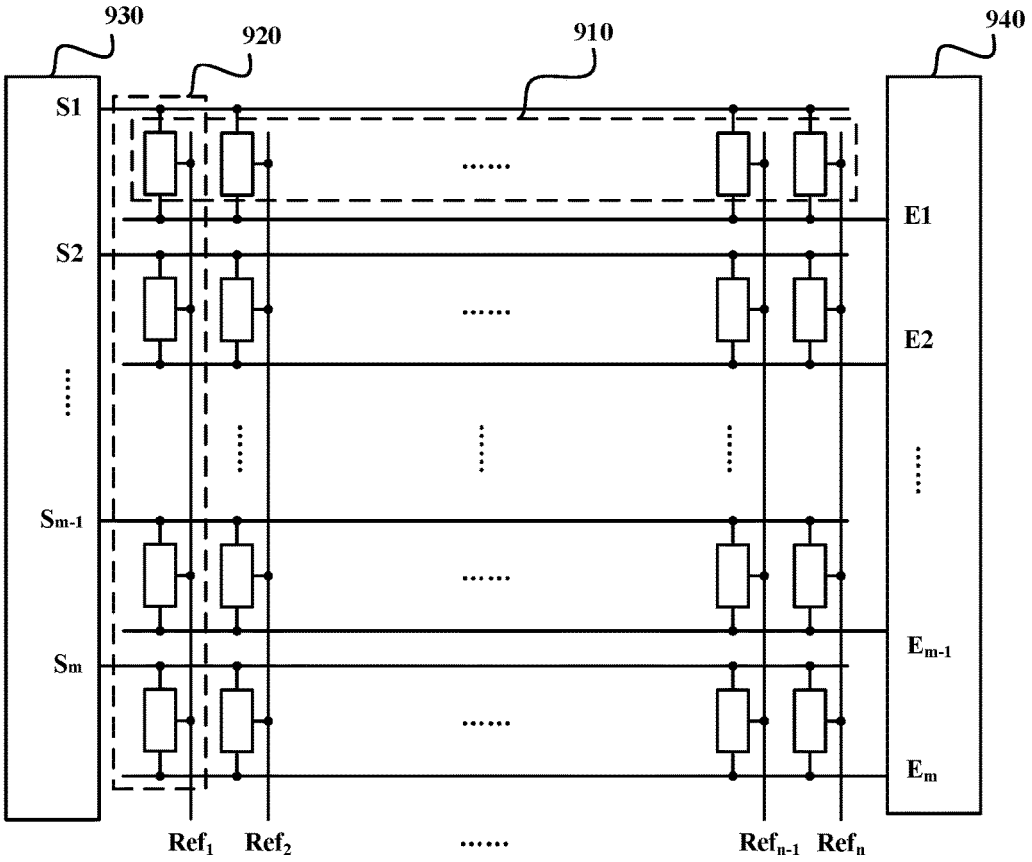
FIG. 9 shows a schematic diagram of an embodiment of an organic light emitting display panel of the present application.

With further reference to FIG. 9, a schematic diagram of an embodiment of an organic light emitting display panel of the present application is shown.

As shown in FIG. 9, the organic light emitting display panel may include a plurality of rows of pixel units 910 and a plurality of columns of pixel units 920. Each row of the pixel units 910 may include a plurality of the organic light emitting pixel driving circuits disclosed as the embodiments of the present application. For example, each subpixel in each row of the pixel units 910 may include an organic light emitting pixel driving circuit.

Each row of the pixel units may be connected to a second scanning line and a light emitting control line.

For example, in some application scenarios, signals of the second scanning lines S1 to Sm and signals of the light emitting control lines E1 to Em may be generated by two shifting registers 930 and 940, respectively. In these application scenarios, the signals of the second scanning lines S1 to Sm may have the same wave form as that of the S2 in FIG. 4, and the signals of the light emitting control lines E1 to Em may have the same wave form as that of the EMIT in FIG. 4.

In addition, each column of the pixel units is connected to a reference voltage line.

For example, each subpixel in the first column of the pixel units is connected to a reference voltage line Ref1, and each subpixel in the second column of the pixel units is connected to a reference voltage line Ref2, and so on, each subpixel in the $(n-1)_{th}$ column of the pixel units is connected to a reference voltage line Ref(n−1), and each subpixel in the $n^{th}$ column of the pixel units is connected to a reference voltage line Refn.

Alternatively, at least two adjacent columns of pixel units are connected to the same reference voltage line.

Specifically, for example, each subpixel in the first column of the pixel units and the second column of the pixel units is connected to the reference voltage line Ref1, and each subpixel in the third column of the pixel units and the fourth column of the pixel units is connected to the reference voltage line Ref2, and so on.

Thus, the same reference voltage line provides a reference voltage signal Vref for each subpixel in the adjacent two columns of pixel units, reducing a routing of the reference voltage line in the pixel driving circuit, thereby reducing the layout area occupied by the organic light emitting pixel driving circuit in the organic light emitting display panel.

While the above example illustrates that two columns of pixel units are connected to a reference voltage line, this is merely exemplary. It may be understood that the number of columns of the pixel units connected to a reference voltage line may be larger than two, for example, each subpixel in the first to third columns or the first to fourth columns of the pixel units is connected to the reference voltage line Ref1. Those skilled in the art may set this up according to the needs of the actual application scenario.

The organic light emitting display panel of the present embodiment uses the organic light emitting pixel driving circuit described above, so that the data voltage after compensation is first written to the second electrode (or third node) of the driving transistor and then written to the gate (or the second node) of the driving transistor, achieving a separation of the gate of the drive transistor and the data line, avoiding an influence of a parasitic capacitance generated by a signal change on the data line. In addition, since the organic light emitting pixel driving circuit as described above achieves a threshold compensation while increasing the value range of the data voltage signal, the organic light emitting display panel can realize a better display quality.

Figure 10:
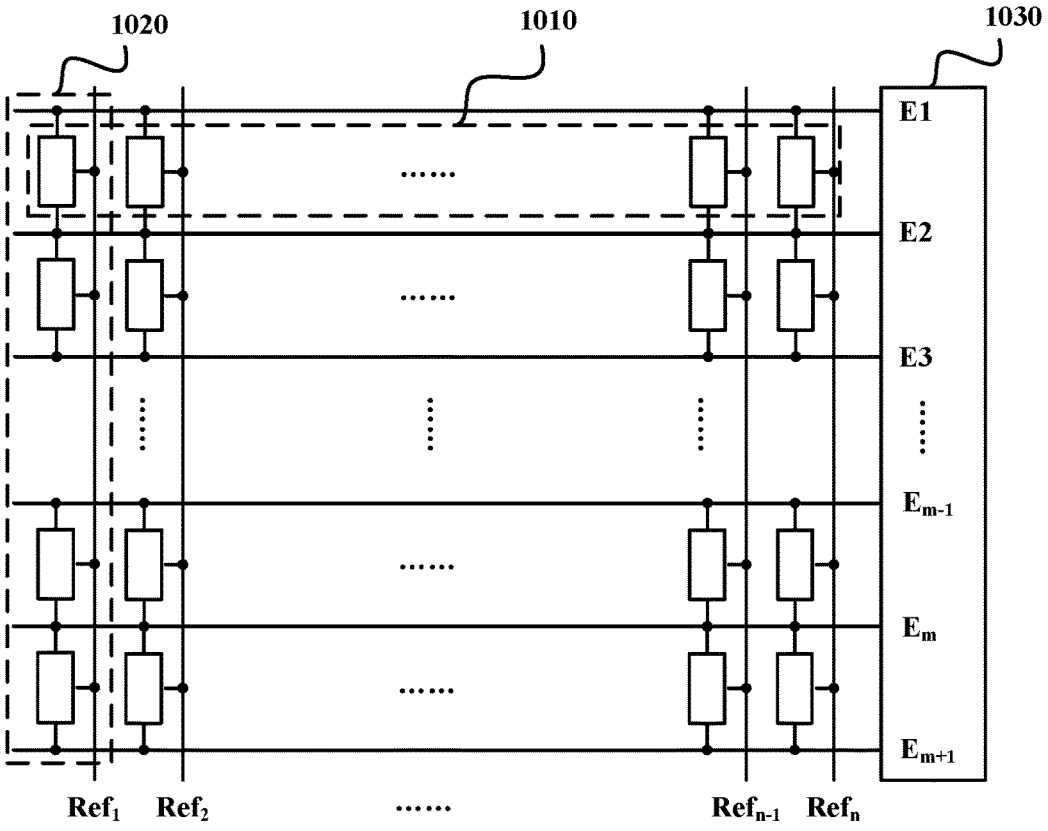
FIG. 10 shows a schematic diagram of another embodiment of the organic light emitting display panel of the present application.

With further reference to FIG. 10, a schematic diagram of another embodiment of the organic light emitting display panel of the present application is shown.

Similarly to the organic light emitting display panel shown in FIG. 9, the organic light emitting display panel of the present embodiment also includes a plurality of rows of pixel units 1010 and a plurality of columns of pixel units 1020. Each row of the pixel units 1010 includes a plurality of the organic light emitting pixel driving circuits of the embodiments of the present application. For example, each subpixel in each row of the pixel units 1010 includes an organic light emitting pixel driving circuit. In addition, each row of the pixel units 1010 is connected to a second scanning line and a light emitting control line.

Unlike the embodiment shown in FIG. 9, in the present embodiment, the light emitting control line connected to the $i_{th}$ row of the pixel units is also used as the second scanning line of the $(i+1)_{th}$ row of the pixel units, i being a positive integer.

Specifically, as shown in FIG. 10, a light emitting control line E2 of the first row of the pixel units is also used as the second scanning line of the second row of the pixel units. In this way, a second scanning signal and the light emitting control signal required for the organic light emitting pixel driving circuits may be generated by the same shifting register 1030, thereby further reducing the layout area occupied by the organic light emitting pixel driving circuit in the organic light emitting display panel.

The organic light emitting pixel driving circuits in the organic light emitting display panel of the present embodiment may be driven by and according to, for example, the timing sequence as shown in FIG. 4.

A utility relationship of the second scanning line and the light emitting control line in adjacent two rows of the pixel units will be described with reference to the timing sequence of FIG. 11.

Figure 11:
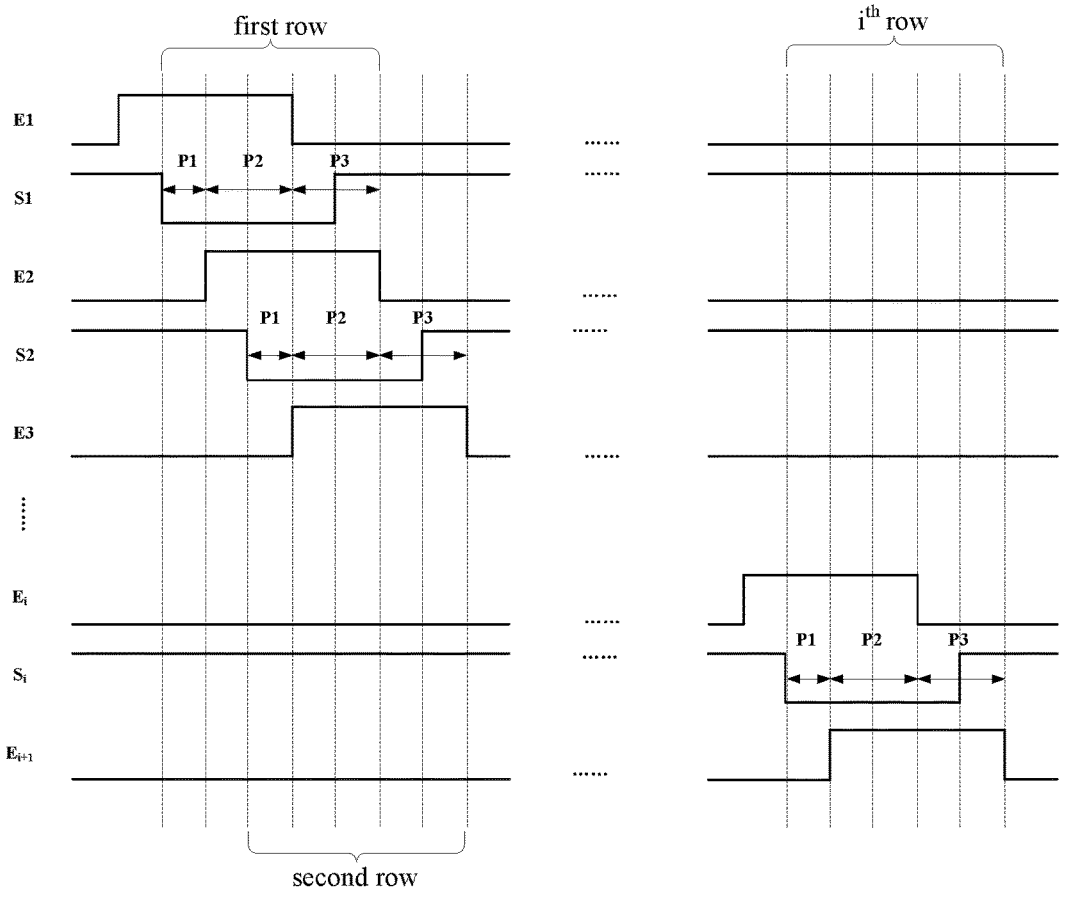
FIG. 11 shows a timing sequence diagram of a signal applied on a second scanning line and a signal applied on the light emitting control line for driving the organic light emitting display panel shown in FIG. 10.

As shown in FIG. 11, the signal applied to the control line E2 is delayed by a P3 phase with respect to the signal applied to the control line E1, therefore, the signal applied to the control line E1 and the signal applied to the control line E2 may be output by two adjacent shifting register units in the shifting register 1030 in FIG. 10. Similarly, the signal applied to the control line Ei+1 is delayed by a P3 stage with respect to the signal applied to the control line Ei, therefore, the signal applied to the control line Ei and the signal applied to the control line Ei+1 may be output by two adjacent shifting register units in the shifting register 1030 in FIG. 10. Here, i is a positive integer, and $0<i\leq m$. In addition, the control line E2 functions as a light emitting control line of each pixel driving circuit in the first row of the pixel units, during the driving of the first row of the pixel units (the first line time period shown in FIG. 11). The control line E2 functions as a second scanning line of each pixel driving circuit in the second row of the pixel units, during the driving of the second row of the pixel units (the second line time period shown in FIG. 11). Similarly, the control line Ei functions as a light emitting control line of each pixel driving circuit in the $(i-1)_{th}$ row of the pixel units, during the driving of the i−1 row of the pixel units. And the control line Ei functions as a second scanning line of each pixel driving circuit in the $i_{th}$ row of the pixel units, during the driving of the $i'_h$ row of the pixel units.

In addition, as can be seen from FIG. 11, the control signal applied to the first scanning line S2 driving the second row can be obtained by delaying a P3 stage by the control signal applied to the first scanning line S1 driving the first row. Similarly, the control signal applied to the first scanning line Si driving the $i_{th}$ row can be obtained by delaying a P3 stage by the control signal applied to the first scanning line $S_{i-1}$ driving the i−1 row.

As can be understood by comparing the organic light emitting display panels shown in FIGS. 9 and 10, if the organic light emitting display panels shown in FIG. 9 and FIG. 10 each include m rows of the pixel units, the organic light emitting display panel shown in FIG. 9 requires m second scanning lines and m light emitting control lines to drive each row of the pixel units. However, in the organic light emitting display panel shown in FIG. 10, since the organic light emitting pixel driving circuits for driving the adjacent row of pixels may share one of the control lines, only m+1 control lines are required to drive each row of the pixel units, thereby further reducing the layout area occupied by the circuits in the organic light emitting display panel.

What have been described above are only preferred embodiments of the present application and illustrations of the employed technical principles. Those skilled in the art should understand that the invention scope related to in the present application is not limited to technical solutions formed by specific combinations of the technical features above, which should also cover other technical solutions formed by any arbitrary combination of the technical features above or their equivalent features without departing from the inventive concept. For example, technical features formed by mutual substitution of the features above with technical features with similar functions disclosed in the present application (but not limited thereto).

What is claimed is:

1. An organic light emitting pixel driving circuit, comprising:

a first capacitor, a second capacitor, a first switching transistor, a second switching transistor, a third switching transistor, a fourth switching transistor, a fifth switching transistor, a data line, a first scanning line, a second scanning line, a light emitting control line, a reference voltage line, an initialization voltage line, a light emitting element and a driving transistor;

wherein a second terminal of the second capacitor is connected to a gate of the driving transistor for storing a voltage transmitted to the gate of the driving transistor;

wherein a second terminal of the first capacitor is directly connected to the second electrode of the driving transistor;

wherein the fourth switching transistor is connected to the reference voltage line for transmitting a signal from the reference voltage line to the first capacitor based on a signal from the second scanning line, a gate of the fourth switching transistor is connected to the second scanning line, and a second electrode of the fourth switching transistor is connected to a first terminal of the first capacitor;

wherein the fifth switching transistor is connected to the second electrode of the driving transistor and an anode of the light emitting element to control the light emitting element to emit light based on a signal from the light emitting control line;

wherein the gates of the first switching transistor, the second switching transistor and the third switching transistor are connected to the first scanning line;

wherein a first electrode of the first switching transistor is connected to the gate of the driving transistor, a second electrode of the first switching transistor is connected to the second electrode of the driving transistor, a first electrode of the second switching transistor is connected to the initialization voltage line, a second electrode of the second switching transistor is connected to the anode of the light emitting element, a first electrode of the third switching transistor is connected to the data line, and a second electrode of the third switching transistor is connected to the first capacitor;

wherein the first switching transistor, the second switching transistor and the third switching transistor are used to reset a potential of the anode of the light emitting element, a potential of the gate of the driving transistor and a potential of the second electrode of the driving transistor based on a signal from the first scanning line, and to transmit a signal from the data line to the first capacitor;

wherein a cathode of the light emitting element is connected to a first power source voltage line; and wherein a first electrode of the driving transistor is connected to a second power source voltage line.

2. The organic light emitting pixel driving circuit according to claim 1, wherein a first electrode of the fourth switching transistor is connected to the reference voltage line.

3. The organic light emitting pixel driving circuit according to claim 1, wherein the first electrode of the fourth switching transistor is connected to the second power source voltage line.

4. The organic light emitting pixel driving circuit according to claim 1, wherein a first terminal of the second capacitor is connected to the second power source voltage line.

5. The organic light emitting pixel driving circuit according to claim 1, wherein a first terminal of the second capacitor is connected to the initialization voltage line.

6. The organic light emitting pixel driving circuit according to claim 1, wherein a gate of the fifth switching transistor is connected to the light emitting control line, a first electrode of the fifth switching transistor is connected to the second electrode of the driving transistor, and a second electrode of the fifth switching transistor is connected to the anode of the light emitting element.

7. A method for driving the organic light emitting pixel driving circuit according to claim 1, comprising:

in an initialization period, providing an initialization voltage signal by the initialization voltage line, providing a data voltage signal by the data line, turning on the fifth switching transistor based on a signal from the light emitting control line, transmitting the initialization voltage signal to the anode of the light emitting element, the second electrode of the driving transistor and the gate of the driving transistor by the first switching transistor, the second switching transistor and the third switching transistor based on the signal from the first scanning line, and transmitting the data voltage signal to the first capacitor by the first switching transistor, the second switching transistor and the third switching transistor;

in a threshold voltage detection period, providing a second voltage signal by the second power source voltage line, turning off the fifth switching transistor based on a signal from the light emitting control line, raising a voltage signal on the gate and the second electrode of the driving transistor from the initialization voltage signal to a value below the second voltage signal, and completing a threshold detection to the driving transistor;

in a data wiring period, providing a high resistance signal by the data line, providing a reference voltage signal by the reference voltage line, transmitting the reference voltage signal to the first capacitor by the fourth switching transistor based on a signal from the second scanning line, transmitting a voltage signal change on the first capacitor to the second electrode of the driving transistor under a coupling action of the first capacitor and then to the gate of the driving transistor, and completing the writing of data; and in a light emitting period, turning off the first switching transistor, the second switching transistor and the third switching transistor based on a signal from the first scanning line, turning on the fifth switching transistor based on a signal of the light emitting control line, and emitting light by the light emitting element.

8. The method according to claim 7, wherein the initialization voltage signal in an initialization period is not larger than a voltage signal provided from the first power source voltage line.

9. An organic light emitting display panel, comprising: a plurality of rows of pixel units and a plurality of columns of pixel units, each row of the pixel units including a plurality of the organic light emitting pixel driving circuits according to claim 1.

10. The organic light emitting display panel according to claim 9, wherein the pixel units in each row are connected to a same second scanning line and a same light emitting control line.

11. The organic light emitting display panel according to claim 9, wherein each column of the pixel units is connected to the reference voltage line.

12. The organic light emitting display panel according to claim 11, wherein at least two adjacent columns of the pixel units are connected to the reference voltage line.

13. A method for operating an organic light emitting pixel driving circuit, wherein the organic light emitting pixel driving circuit comprises:

a first capacitor, a second capacitor, a first switching transistor, a second switching transistor, a third switching transistor, a fourth switching transistor, a fifth switching transistor, a data line, a first scanning line, a second scanning line, a light emitting control line, a reference voltage line, an initialization voltage line, a light emitting element and a driving transistor;

wherein the second capacitor is connected to a gate of the driving transistor for storing a voltage transmitted to the gate of the driving transistor;

wherein the first capacitor is connected to a second electrode of the driving transistor, the first switching transistor, the fourth switching transistor, the third switching transistor;

wherein the fourth switching transistor is connected to the reference voltage line for transmitting a signal from the reference voltage line to the first capacitor based on a signal from the second scanning line;

wherein the fifth switching transistor is connected to the second electrode of the driving transistor and an anode of the light emitting element to control the light emitting element to emit light based on a signal from the fifth switching transistor;

wherein the first switching transistor, the second switching transistor, the third switching transistor are connected to the initialization voltage line, the data line, the anode of the light emitting element, the first capacitor, the gate of the driving transistor and the second electrode of the driving transistor to reset a potential of the anode of the light emitting element, a potential of the gate of the driving transistor and a potential of the second electrode of the driving transistor based on a signal from the first scanning line, and to transmit a signal from the data line to the first capacitor;

wherein a cathode of the light emitting element is connected to a first power source voltage line; and wherein a first electrode of the driving transistor is connected to a second power source voltage line, wherein the method comprises:

in an initialization period, providing an initialization voltage signal by the initialization voltage line, providing a data voltage signal by the data line, turning on the fifth switching transistor based on a signal from the light emitting control line, transmitting the initialization voltage signal to the anode of the light emitting element, the second electrode of the driving transistor and the gate of the driving transistor by the first switching transistor based on a signal from the first scanning line, and transmitting the data voltage signal to the first capacitor by the third switching transistor;

in a threshold voltage detection period, providing a second voltage signal by the second power source voltage line, turning off the fifth switching transistor based on a signal from the light emitting control line, raising a voltage signal on the gate and the second electrode of the driving transistor from the initialization voltage signal to a value below the second voltage signal, and completing a threshold detection to the driving transistor;

in a data wiring period, providing a high resistance signal by the data line, providing a reference voltage signal by the reference voltage line, transmitting the reference voltage signal to the first capacitor by the fourth switching transistor based on a signal from the second scanning line, transmitting a voltage signal change on the first capacitor to the second electrode of the driving transistor under a coupling action of the first capacitor and then to the gate of the driving transistor, and completing the writing of data; and in a light emitting period, turning off the first switching transistor, the second switching transistor, the third switching transistor based on a signal from the first scanning line, turning on the fifth switching transistor based on a signal of the light emitting control line, and emitting light by the light emitting element.

14. The method according to claim 13, wherein the initialization voltage signal in an initialization period is not larger than a voltage signal provided from the first power source voltage line.

* * * * *